United States Patent [19]

Proia et al.

[11] 4,140,140

[45] Feb. 20, 1979

[54] COMBINED TOOTHBRUSH AND PILL DISPENSER

[75] Inventors: Gianfranco Proia; Guy Benhamou, both of San Francisco, Calif.

[73] Assignee: Orimport Corp., San Francisco, Calif.

[21] Appl. No.: 878,815

[22] Filed: Feb. 17, 1978

[51] Int. Cl.[2] ..... A45D 44/18

[52] U.S. Cl. ..... 132/84 B

[58] Field of Search ..... 132/845, 85; 206/531, 206/2, 534, 534.2, 538, 533; 15/184; 222/71

[56] References Cited

U.S. PATENT DOCUMENTS

| | | | |
|---|---|---|---|
| Re. 14,589 | 2/1919 | Booth | 132/84 C |
| 1,299,430 | 4/1919 | Da Costa | 46/193 |
| 1,364,188 | 1/1921 | Draenert | 132/84 B |
| 1,413,064 | 4/1922 | Salfisberg | 206/538 |
| 1,540,911 | 6/1925 | Soneshein | 132/84 A |
| 2,240,876 | 5/1941 | Waterud | 15/184 |
| 2,313,667 | 3/1943 | Peterson | 206/538 |
| 2,443,425 | 6/1943 | Iverson | 132/84 |
| 2,601,244 | 6/1952 | Boulicault | 132/84 B |
| 2,662,336 | 12/1953 | Zalkind | 46/43 |
| 3,450,306 | 6/1969 | Gill | 222/71 |
| 3,472,367 | 10/1969 | Hellstrom | 206/538 |
| 3,542,519 | 11/1970 | Montalto et al. | 132/84 R |
| 3,593,725 | 7/1971 | Ortega | 132/84 B |
| 3,651,927 | 3/1972 | Richardson et al. | 206/42 |
| 3,654,890 | 4/1972 | Rigney et al. | 116/121 |
| 3,991,776 | 11/1976 | Duffy | 132/84 R |
| 4,015,717 | 4/1977 | Richardson et al. | 206/534 |

FOREIGN PATENT DOCUMENTS

| | | | |
|---|---|---|---|
| 351159 | 6/1931 | United Kingdom | 132/84 C |

*Primary Examiner*—G.E. McNeill

*Attorney, Agent, or Firm*—Roylance, Abrams, Berdo & Farley

[57] ABSTRACT

A toothbrush or other hygienic device typically used regularly on a daily basis by the average person includes a handle in the form of a pill dispenser. The handle is constructed as a hollow tubular member and has openings in its longitudinal sides for holding the pills. Each pill is releasably sealed within one of the openings by plastic sheets, one of which is frangible to permit removal of a pill. The handle may be detachably connected to the remainder of the device and is closed at an open end thereof by a plug. The plug may be used to free a pill from its opening. Indicia is imprinted on the exposed surface of one of the plastic sheets to permit identification of each pill.

13 Claims, 3 Drawing Figures

COMBINED TOOTHBRUSH AND PILL DISPENSER

BACKGROUND OF THE INVENTION

This invention relates to a pill dispenser which is embodied in a device, such as a toothbrush, which is used invariably on a regular daily basis.

Known and conventional means for dispensing such medication as birth control pills include a mechanism for assuring that only a single pill may be dispensed at a time or some kind of indicia which corresponds with the dispensing of pills. However, these prior art pill dispensers have not heretofore been combined with a toothbrush or other regularly used hygienic instrument to produce a practical device.

The prior art has suggested the combination of a toothbrush with some sort of dispensing means. Typical examples are U.S. Pat. Nos. 3,991,776, Duffy; U.S. Pat. No. 2,443,425, Iverson; and U.S. Pat. No. 2,240,876, Waterud. However, none of these prior art devices would be effective in dispensing at regular intervals only a prescribed dosage of medication, indicating whether or not the prescribed dosage has been taken, and reminding the patient to take the prescribed dosage at the appropriate time, as well as storing the medication in a convenient location. The ability to perform all of these functions effectively and simultaneously is particularly important when dealing with such drugs as birth control pills which must be taken invariably on a daily basis to accomplish their intended purpose.

One object of this invention is to provide a hygienic instrument which is invariably used on a daily basis which will daily remind the user thereof to take his or her medication as prescribed. In particular, it is the object of the present invention to combine in an effective manner a toothbrush with a birth control pill dispenser so that when one brushes one's teeth each morning, one is reminded to take the pill as prescribed.

Another object of the present invention is to provide a pill dispenser which will protect the medication from moisture and other environmental contaminants. In particular, it is the object of the present invention to seal each pill individually within the handle of an hygienic instrument so as to allow each pill to be removed individually.

A further object of the present invention is to provide a dispenser which will indicate the order, prescribed time of taking and/or nature of the medicine, and indicate whether the medicine has been taken. In particular, it is the object of the present invention to provide indicia at the location of each pill which specifies the nature, order and/or time of taking of the pill, and to form the means for holding the pill so that it visually indicates the presence or absence of each pill from its designated position in the handle.

Yet another object of the present invention is to provide an hygienic instrument with a pill dispenser detachably connected thereto so that the supply of medicine may be replaced upon exhaustion thereof without replacing the entire instrument.

Still another object of the present invention is to provide a convenient and effective location for medicine when traveling.

Other objects, advantages and salient features of the present invention will become apparent from the following detailed description of a preferred embodiment of the present invention.

SUMMARY OF INVENTION

The foregoing objects are attained by an hygienic device, such as a toothbrush, having a hollow handle detachably connected to the brush portion thereof. The hollow handle defines a pill receiving chamber and has openings in the lateral sides thereof. A pill is retained within each opening by thin sheets of plastic secured at the opposed sides of each opening. The plastic on the interior side of each opening is capable of fracturing to permit a pill to be pushed into the pill receiving chamber. One end of the handle is open to permit a pill, which has been pushed from its encapsulated position in a handle opening into the pill receiving chamber, to be slid out of the chamber and into the user's hand. The open end of handle is closed by a plug which may be employed to push a pill through the plastic sheets which retain it within a handle opening.

SUMMARY OF THE DRAWINGS

Referring to the drawings, which form a part of this original disclosure.

DETAILED DESCRIPTION

Figure 1:
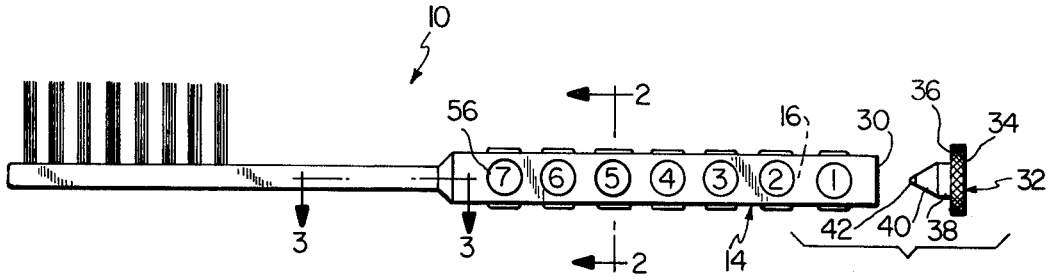
FIG. 1 is a side view of a combined toothbrush and pill dispenser in accordance with the present invention.
Figure 2:
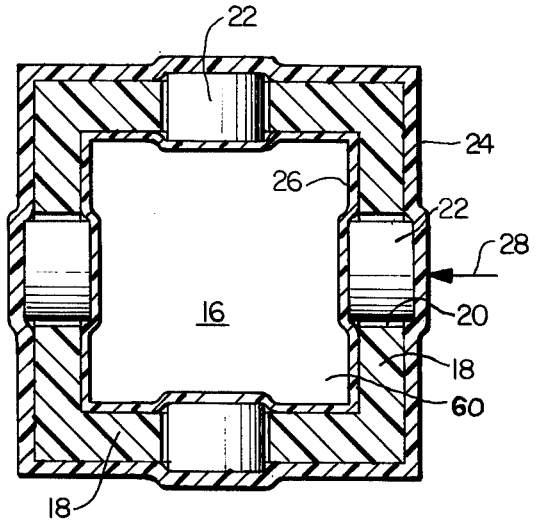
FIG. 2 is an enlarged sectional view of a portion of the handle taken along lines 2—2 of FIG. 1.

Referring to FIGS. 1 and 2, a toothbrush generally designated 10 comprises two portions, a brush portion generally designated 12 and a handle portion generally designated 14. Both portions are preferably formed of plastic. The brush portion 12 is of a standard composition and form. The handle portion 14 is advantageously shaped as a hollow rectangular solid. The hollow interior of the handle defines a pill receiving chamber 16. Each of the four rectangular longitudinal sides 18 of the handle portion 14 has a plurality of circular openings 20 arranged in a line which extend from the exterior surface of the handle to the chamber 16. Each opening 20 is adapted to receive and retain a pill 22. The opening 20 is of a slightly greater diameter than the pill 22. The sides 18 are formed to be slightly thinner than the pill 22.

The pills are releasably retained within the openings 20 by means of thin plastic sheets 24 and 26. The exterior sheet 24 is relatively flexible so that it will bend when a force is applied thereto in the direction of arrow 28 at the pill sought to be removed. The interior sheet 26 is thinner than the exterior sheet 24 and is capable of being fractured when the force is applied in the direction shown by the arrow 28 in FIG. 2. The sheets 24, 26 are adhered directly to the exterior and interior surfaces, respectively, of the handle portion 14. At least the outer plastic sheet 24 is transparent to permit visual observation of the pills 22 in the openings 20.

The open end 30 of the pill receiving chamber 16 is closed by a plug generally designated 32. The plug 32 has an enlarged section 34 which provides a gripping surface on the lateral sides thereof to facilitate insertion, removal and manipulation of the plug 32. A shoulder 36 is formed on the enlarged portion 34 to engage the edge of the handle portion 14 at the open end 30. A tubular portion 38 extends outwardly from one face of the enlarged portion 34 to engage the interior surfaces of the sides 18 in an interference fit so as to retain removably the plug within the open end 30 and to seal the pill receiving chamber 16. A conical portion 40 terminating in a rounded tip 42 extends from the tubular portion 38. The conical portion 40 of the plug 32 may be used to apply the force shown by arrow 28 to push the pill 22 into the pill receiving chamber 16.

Figure 3:
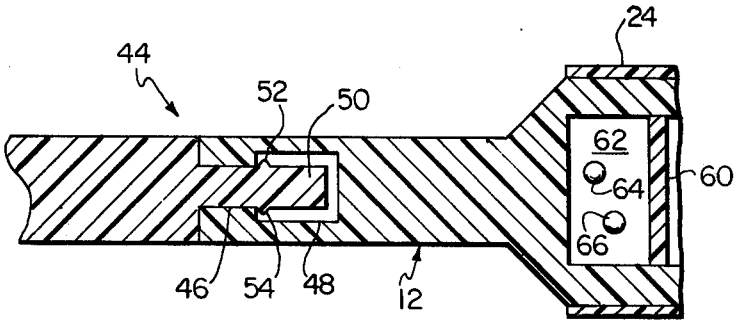
FIG. 3 is an enlarged sectional view of a portion of the handle taken along lines 3—3 of FIG. 1.

The handle and the brush portions 12 and 14, respectively, may be coupled by a detachable connection 44. The details of the detachable connection are shown in FIG. 3. The brush portion end of the connection 44 comprises a longitudinal bore extending inwardly from the end for a determined distance. The bore has two longitudinally spared sections 46, 48. The inner section 46 has a greater cross-sectional area than that of the outer section 48. The handle portion end has a male projection 50 with resilient annular ring 52 formed integrally therewith. When the projection 50 is inserted into bore section 46, the ring 52 is compressed. Upon entering bore section 48 the ring 52 expands to lock the handle and brush portions together. The ring 52 is located on the projection 50 a distance from the point the projection 50 emerges from the handle portion end equal to the longitudinal length of bore section 46 so that the ring 52 abuts the shoulder 54 between the bore sections 46, 48. The cross-sectional configurations of the projection 50 and bore section 46 are so chosen so as to cooperate to prevent relative rotation of the brush and handle portions upon mating. For example, the cross-sections may be of polygonal configuration or may be provided with mating ridges and grooves.

The exterior sheet 24 may be imprinted with indicia 56 at the location of each pill 22. The indicia may indicate the time, the sequence of taking, or the nature of each pill.

To remind the person using the toothbrush 10 to take one of the pills 22, a noisemaker is provided in handle portion 14. As seen in FIG. 3, this noisemaker is formed by providing a wall 60 near the end of chamber 16 to define a second chamber 62 receiving spherical steel ball-bearings 64 and 66 therein. When the toothbrush 10 is used, these bearings will rattle, thereby providing the noise to remind the user to take a pill.

It will be apparent to those skilled in this art that various changes and modifications can be made without departing from the spirit and scope of the invention as defined in the appended claims. For example, the arrangement of the detachable coupling between the handle portion and the brush portion may be reversed so as to provide the projection on the brush portion and the bore sections on the handle portion. Also, the present invention may be embodied in such other hygienic instruments as hairbrushes and combs. Additionally, any type of medication may be provided in the handle openings, including a plurality of different types of drugs which may be necessary and conveniently stored while traveling, e.g., aspirin, antacids, toothpowder, etc.

What is claimed is:

1. A combined hygienic instrument and pill dispenser comprising:

an instrument portion;

a handle portion coupled to said instrument portion;

said handle portion being hollow and defining a pill receiving chamber therein, the end of said chamber remote from the instrument portion being open;

at least one opening formed in a longitudinal side of said handle portion to receive a pill in the form of a tablet, said opening extending entirely through said longitudinal side from the exterior of said handle portion to said chamber;

a first sheet of plastic extending across the exterior surface of said handle portion to cover the exterior end of said opening;

a second sheet of plastic extending across the interior surface of said handle portion to cover the interior end of said opening; and said first and second sheets releasably retaining the pill within said opening and sealing the pill from the environment.

2. A combined hygienic instrument and pill dispenser according to claim 1, wherein said instrument portion is in the form of a toothbrush.

3. A combined hygienic instrument and pill dispenser according to claim 1, wherein said first sheet is flexible and said second sheet is frangible whereby application of a force on said first sheet at said opening causes said second sheet to break thereby permitting a pill to be dislodged from the opening and pushed into said pill receiving chamber.

4. A combined hygienic instrument and pill dispenser according to claim 3, wherein said first sheet is thicker than said second sheet.

5. A combined hygienic instrument and pill dispenser according to claim 1, wherein said handle portion is provided with a plurality of a pill receiving openings which are each covered by said first and second plastic sheets.

6. A combined hygienic instrument and pill dispenser according to claim 1, further including a plug mounted in said open end of said chamber to close and seal said chamber.

7. A combined hygienic instrument and pill dispenser according to claim 6, wherein said plug includes means for pushing a pill through said second sheet.

8. A combined hygienic instrument and pill dispenser according to claim 7, wherein said means comprises a conical projection on said plug.

9. A combined hygienic instrument and pill dispenser according to claim 1, further including means for detachably coupling said instrument portion to said handle portion to permit replacement of said handle portion upon consumption of all the pills therein.

10. A combined hygienic instrument and pill dispenser according to claim 1, wherein a pill is provided in said opening between said sheets, the pill being thicker than the longitudinal side in which said opening is located.

11. A combined hygienic instrument and pill dispenser according to claim 1, wherein said handle portion is in the shape of a rectangular solid having four rectangular longitudinal sides, each of said sides having a plurality of pill receiving openings arranged in a line covered by first and second plastic sheets at the exterior and interior ends of each opening.

12. A combined hygienic instrument and pill dispenser according to claim 1, wherein indicia is provided on said first sheet at said opening.

13. A combined hygienic instrument and pill dispenser according to claim 1, and further including means, coupled to said handle portion, for making noise upon manipulation of said combined instrument and dispenser.

* * * * *